US009646796B1

(12) United States Patent
Wang et al.

(10) Patent No.: US 9,646,796 B1
(45) Date of Patent: May 9, 2017

(54) CARBURIZED LUTETIUM OXIDE DOPED MOLYBDENUM CATHODE AND ITS FABRICATION METHOD

(71) Applicant: BEIJING UNIVERSITY OF TECHNOLOGY, Beijing (CN)

(72) Inventors: Jin-Shu Wang, Beijing (CN); Wei Liu, Beijing (CN); Li-Ran Dong, Beijing (CN); Qiang Wang, Beijing (CN); Xiang Liu, Beijing (CN); Fan Zhou, Beijing (CN); Mei-Ling Zhou, Beijing (CN); Tie-Yong Zuo, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 960 days.

(21) Appl. No.: 14/218,680

(22) Filed: Mar. 18, 2014

(30) Foreign Application Priority Data

Dec. 24, 2013 (CN) ..... 2013 1 0723707

(51) Int. Cl.

| | |
|---|---|
| ***H01J 19/06*** | (2006.01) |
| ***H01K 1/04*** | (2006.01) |
| ***H01J 1/14*** | (2006.01) |
| ***H01J 1/28*** | (2006.01) |
| ***H01J 1/142*** | (2006.01) |
| ***H01J 1/20*** | (2006.01) |
| ***H01J 9/04*** | (2006.01) |

(52) U.S. Cl.
CPC *H01J 1/28* (2013.01); *H01J 1/14* (2013.01); *H01J 1/142* (2013.01); *H01J 1/20* (2013.01); *H01J 9/042* (2013.01)

(58) Field of Classification Search
CPC ..... H01J 1/28; H01J 1/14; H01J 1/142; H01J 1/20; H01J 9/042
See application file for complete search history.

*Primary Examiner* — Donald Raleigh
(74) *Attorney, Agent, or Firm* — J.C. Patents

(57) ABSTRACT

A method of manufacturing carburized $Lu_2O_3$ doped Mo cathodes for thermionic emission for magnetrons is described. The $Lu_2O_3$ doped Mo powder is prepared by sol-gel method. The powder is reduced thoroughly in hydrogen atmosphere. Afterwards, the powder is die-pressed into pellets, followed by sintering in hydrogen and carburization in activated carbon powder to obtain the carburized $Lu_2O_3$ doped Mo cathode.

13 Claims, 2 Drawing Sheets

CARBURIZED LUTETIUM OXIDE DOPED MOLYBDENUM CATHODE AND ITS FABRICATION METHOD

CROSS-REFERENCE TO RELATED APPLICATION

This application claims priority benefit of Chinese application No. 201310723707.0 filed on Dec. 24, 2013, the content of which is herein incorporated by reference in its entirety.

TECHNICAL FIELD

The present disclosure relates to a carburized lutetium oxide ($Lu_2O_3$) doped molybdenum (Mo) cathode and its fabrication method, which belongs to the technical field of rare earth-refractory metal cathodes.

BACKGROUND OF RELATED ART

Electron tubes and magnetrons have been used extensively in radar, navigation, electronic countermeasure, and microwave devices. Thermionic emission cathode is one of the key components of electron tubes and magnetrons and plays an important role in the operation of these devices. Up to now, thoriated cathode ($ThO_2$—W) which is still widely used in electron tube and microwave oven magnetrons. Nevertheless, it is necessary to find other environment-friendly elements to substitute thorium as thorium is a radioactive element. Lanthanum oxide-molybdenum ($La_2O_3$—Mo) cathode was found to have a certain thermionic emission property. However, during the operation of magnetrons at an external magnetic field, a large number of electrons emitted back-bombarded the $La_2O_3$—Mo cathode, resulting in the evaporation and loss of lanthanum on the cathode surface and thus the poor emission stability of this kind of cathode. Among all the rare earth elements, lutetium (Lu) has the highest melting point. In this patent, we propose a kind of $Lu_2O_3$ doped Mo cathode for thermionic emission and its fabrication methods.

SUMMARY

The present disclosure provides a carburized lutetium oxide doped molybdenum cathode and its fabrication method. The $Lu_2O_3$ doped Mo powder is prepared by sol-gel method in which solutions of lutetium nitrate ($Lu(NO_3)_3$), ammonium molybdate ($(NH_4)_6Mo_7O_{24}$), and citric acid ($C_6H_8O_7$) are employed. The prepared powder is die-pressed to form pellets before they are sintered and carburized to obtain carburized $Lu_2O_3$ doped Mo cathodes.

In some embodiments, the quantity of lutetium oxide ranges from 1 to 4% by weight.

In some embodiments, the mass of citric acid is 1 to 1.3 times of $(NH_4)_6Mo_7O_{24}.4H_2O$.

In some embodiments, the $Lu_2O_3$ doped Mo powder is prepared by Sol-Gel method, with addition of $Lu(NO_3)_3$ solution and citric acid into $(NH_4)_6Mo_7O_{24}$ solution simultaneously and slowly.

In some embodiments, the wet gel is calcined in air atmosphere at a temperature between 500 and 600° C. until the wet gel is calcined completely.

In some embodiments, the $Lu_2O_3$ doped Mo powder is obtained from the xerogel by two steps: firstly, the xerogel is calcined in hydrogen atmosphere at 500-550° C. for 2 h to obtain the $Lu_2O_3$ doped $MoO_2$ powder, secondly, the powder from the first step is further calcined in hydrogen at 850-950° C. for 2 h to obtain the $Lu_2O_3$ doped Mo powder.

In some embodiments, the pellet is sintered in hydrogen at 1800-2000° C. for 60-120 min to obtain a cathode.

In some embodiment, the cathode is carburized in activated carbon powder at 1400-1500° C. for 5-20 min.

There are a number of advantages provided by the techniques employed in the present disclosure. The sol-gel method exhibits excellent mixture of $Lu_2O_3$ and Mo powders. The rare earth oxide in the substrate exhibits favorable thermionic emission performances, i.e. the maximum thermionic emission current density for the cathode containing 4 wt % $Lu_2O_3$ is 1.02 A/cm$^2$ at 1400° C., similar to that of the Mo cathode containing 4 wt % $La_2O_3$. Furthermore, the Mo cathode with 3 wt % $Lu_2O_3$ meets the requirement of thermionic emission current densities of 0.3-0.8 A/cm$^2$ for microwave oven magnetrons.

BRIEF DESCRIPTION OF THE DRAWINGS

The techniques of the present disclosure are described in detail with reference to the accompanying drawings.

DETAILED DESCRIPTION OF THE PREFERRED EMBODIMENTS

In the following description, the carburized $Lu_2O_3$ doped Mo cathode is obtained according to the present disclosure.

Figure 1:
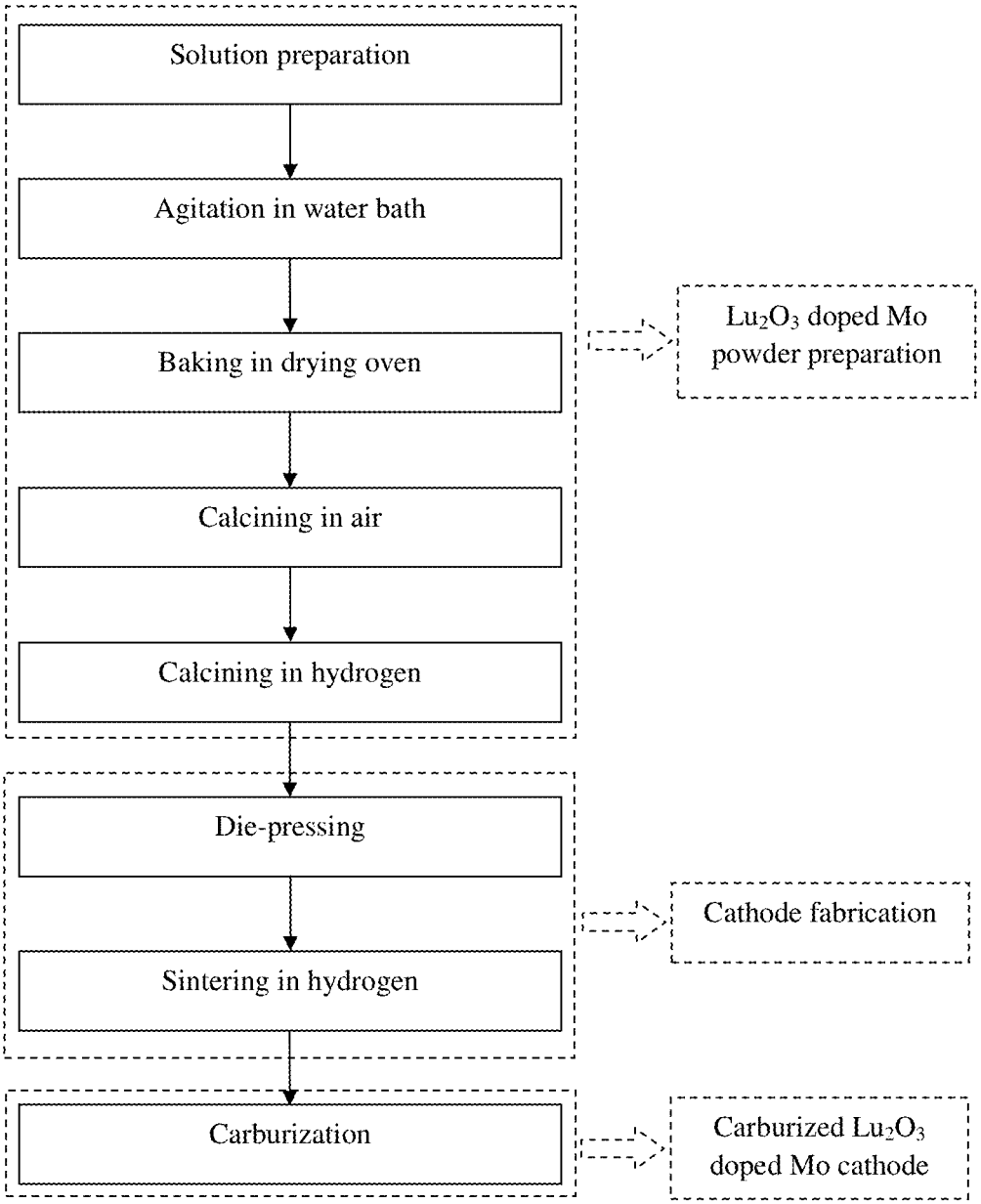
FIG. 1 is a flow diagram of the processes for manufacturing carburized $Lu_2O_3$ doped Mo cathode.

FIG. 1 is a flow diagram of the processes for manufacturing the carburized $Lu_2O_3$ doped Mo cathodes. Initially, aqueous solutions of lutetium nitrate ($Lu(NO_3)_3$), ammonium heptamolybdate ($(NH_4)_6Mo_7O_{24}$), and citric acid ($C_6H_8O_7$) of certain concentrations are prepared, respectively. Then, the $Lu(NO_3)_3$ solution and the citric acid solution are added into the $(NH_4)_6Mo_7O_{24}$ solution simultaneously and slowly. The mixed solution is changed to a yellow wet gel after constant stirring. The wet gel is transformed to a xerogel after it is baked in a drying oven. The xerogel is calcined in an electric furnace at 500-600° C. and followed by calcining in hydrogen atmosphere at 500-550° C. for 2 h and then 850-9501 for 2 h to obtain the $Lu_2O_3$ doped Mo powder. The powder is carefully grinded and sieved through a standard screen of 200-mesh. The powder is pressed into pellets of 03 mm. The pellets are sintered in hydrogen at 1800-2000° C. for 60-120 min to develop a cathode. Finally, the cathode is carburized in activated carbon powder at 1400-1500° C. for 5-20 min.

In some embodiments, the concentration of the rare earth oxide ranges from 1-4 wt %.

In some embodiments, the mass of citric acid is 1-1.3 times of ammonium heptamolybdate.

In some embodiments, the order of mixing the solution is to add the $Lu(NO_3)_3$ solution and the citric acid solution into the $(NH_4)_6Mo_7O_{24}$ solution simultaneously and slowly.

In some embodiments, the wet-gel is calcined at 500-600° C. in an electric furnace until the wet gel is calcined completely.

In some embodiments, the $Lu_2O_3$ doped molybdenum powder is developed in two steps: firstly, the xerogel is calcined at 500-550° C. for 2 h in hydrogen atmosphere to obtain the $Lu_2O_3$ doped $MoO_2$ powder; secondly, the powder from the first step is further calcined at 850-950° C. for 2 h in hydrogen to obtain the $Lu_2O_3$ doped Mo powder.

In some embodiments, the pellets are sintered at 1800-2000° C. for 60-120 min in hydrogen to obtain cathodes.

In some embodiment, the cathode is carburized in activated carbon powder at 1400-1500° C. for 5-20 min.

Figure 2:
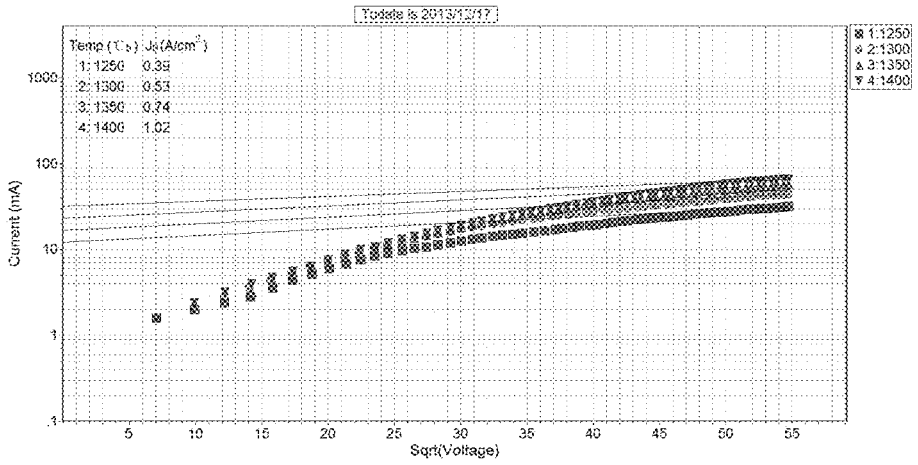
FIG. 2 is a graph exhibiting the voltage-current density curves of a carburized Mo cathode doped with 4 wt % $Lu_2O_3$.
Figure 3:
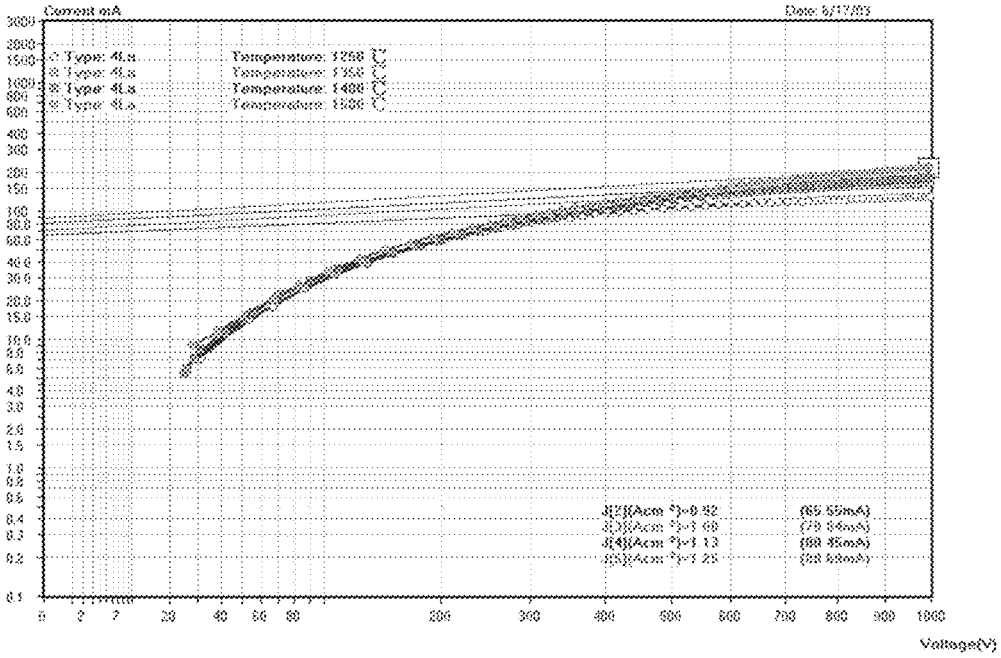
FIG. 3 is a graph exhibiting the voltage-current density curves of a carburized Mo cathode doped with 4 wt % $La_2O_3$.

The emission performance of the carburized $Lu_2O_3$ doped Mo cathode manufactured according to the present disclosure is evaluated at different activation temperatures (FIG. 2) and is compared with that of conventional La—Mo cathode (FIG. 3, Table1). FIG. 2 reveals that after activation of the carburized $Lu_2O_3$ doped Mo cathode at 1600° C., the maximum thermionic emission current density at 1400° C. is 1.02 $A/cm^2$, similar to the thermionic emission current density of the carburized molybdenum cathode doped with 4 wt % $La_2O_3$. The thermionic emission current density in the range of 0.3-0.8 $A/cm^2$ is required for the cathode in a magnetron. Therefore, the carburized $Lu_2O_3$ doped molybdenum cathode satisfies the requirement in magnetrons.

EXAMPLES

Example 1

Aqueous solutions of $Lu(NO_3)_3$, $(NH_4)_6Mo_7O_{24}$ and citric acid were made by dissolving 0.419 g $Lu(NO_3)_3.H_2O$, 19.838 g $(NH_4)_6Mo_7O_{24}.4H_2O$, 20.257 g of $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked to a xerogel in a drying oven. The xerogel is calcined in an electric furnace at 500° C., followed by calcining in dry hydrogen at 500° C. for 2 h and then 850° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1800° C. for 60 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 2

Aqueous solutions of $Lu(NO_3)_3$, $(NH_4)_6Mo_7O_{24}$ and citric acid were made by dissolving 0.533 g $Lu(NO_3)_3.H_2O$, 25.248 g $(NH_4)_6Mo_7O_{24}.4H_2O$, 25.781 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked into a xerogel in a drying oven. The xerogel is calcined in an electric furnace at 500° C., followed by calcining in dry hydrogen at 500° C. for 2 h and then a higher temperature of 800° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1900° C. for 60 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 3

Aqueous solutions of $Lu(NO_3)_3$, $(NH_4)_6Mo_7O_{24}$ and citric acid were made by dissolving 0.191 g $Lu(NO_3)_3.H_2O$, 18.218 g $(NH_4)_6Mo_7O_{24}.4H_2O$, 1.000 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked in a drying oven to develop a xerogel. The xerogel is calcined in an electric furnace at 600° C., followed by calcining in dry hydrogen at 500° C. for 2 h and then a higher temperature of 850° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 2000° C. for 60 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 4

Aqueous solutions of $Lu(NO_3)_3$, $(NH_4)_6Mo_7O_{24}$ and citric acid were made by dissolving 0.743 g $Lu(NO_3)_3.H_2O$, 23.205 g $(NH_4)_6Mo_7O_{24}.4H_2O$, 23.948 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a iron container and was baked in a drying oven to develop a xerogel. The xerogel is calcined in an electric furnace at 600° C., followed by calcining in dry hydrogen at 550° C. for 2 h and then a higher temperature of 900° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 2000° C. for 60 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 5

Aqueous solutions of $Lu(NO_3)_3$, $(NH_4)_6Mo_7O_{24}$ and citric acid were made by dissolving 0.800 g $Lu(NO_3)_3.H_2O$, 24.990 g $(NH_4)_6Mo_7O_{24}.4H_2O$, 25.790 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked in a drying oven to develop a xerogel. The xerogel is calcined in an electric furnace at 550° C., followed by calcining in dry hydrogen at 550° C. for 2 h and then a higher temperature of 900° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1900° C. for 120 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 6

Aqueous solutions of $Lu(NO_3)_3$, $(NH_4)_6Mo_7O_{24}$ and citric acid were made by dissolving 0.629 g $Lu(NO_3)_3.H_2O$, 19.635 g $(NH_4)_6Mo_7O_{24}.4H_2O$, 20.246 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked in a drying oven to develop a xerogel. The xerogel is calcined in an electric furnace at 550° C., followed by calcining in dry hydrogen at 550° C. for 2 h and then a higher temperature of 900° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1900° C. for 60 min in hydrogen, followed by carburization in activated carbon powder at 1400° C. for 20 min to obtain carburized $Lu_2O_3$ doped molybdenum cathodes. The thermionic emission current density of the cathode was tested at 1400° C. after being activated at 1600° C.

Example 7

Aqueous solutions of $Lu(NO_3)_3$, $(NH_4)_6Mo_7O_{24}$ and citric acid were made by dissolving 0.971 g $Lu(NO_3)_3.H_2O$, 30.345 g $(NH_4)_6Mo_7O_{24}H_2O$, 31.316 g $C_6H_8O_7.H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked in a drying oven to develop a xerogel. The xerogel is calcined in an electric furnace at 550° C., followed by calcining in dry hydrogen at 550° C. for 2 h and then a higher temperature of 900° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1900° C. for 60 min in hydrogen, followed by carburization in activated carbon powder at 1500° C. for 10 min to obtain carburized $Lu_2O_3$ doped molybdenum cathodes. The thermionic emission current density of the cathode was tested at 1400° C. after being activated at 1600° C.

Example 8

Aqueous solutions of $Lu(NO_3)_3$, $(NH_4)_6Mo_7O_{24}$ and citric acid were made by dissolving 1.067 g $Lu(NO_3)_3.H_2O$, 24.733 g $(NH_4)_6Mo_7.4H_2O$, 25.800 g $C_6H_8O_7H_2O$ in de-ionized water, respectively. Afterwards, the solutions of $Lu(NO_3)_3$ and citric acid were added into the $(NH_4)_6Mo_7O_{24}$ solution simultaneously and slowly. A wet gel was formed after a couple of hours. The wet gel was transferred to a container and was baked in a drying oven to develop a xerogel. The xerogel is calcined in an electric furnace at 550° C., followed by calcining in dry hydrogen at 550° C. for 2 h and then a higher temperature of 900° C. for 2 h to obtain $Lu_2O_3$ doped molybdenum powder. The powder is carefully grinded and sieved through a standard screen of 200-mesh. 0.081 g of the powder was measured and pressed into pellets of size Φ3×2 mm. The pellets were sintered at 1900° C. for 60 min in hydrogen, followed by carburization in activated carbon powder at 1500° C. for 10 min to obtain carburized $Lu_2O_3$ doped molybdenum cathodes. The thermionic emission current density of the cathode was tested at 1400° C. after being activated at 1600° C.

The maximum thermionic emission current densities of the cathodes fabricated from Example 1 to 8 are summarized in Table 1.

TABLE 1

The maximum thermionic emission current densities $j_m$ at 1400° C. and work function of the carburized $Lu_2O_3$ doped molybdenum cathodes

| Samples | $j_m$ |
|---|---|
| Example 1 | 0.51 |
| Example 2 | 0.50 |
| Example 3 | 0.43 |
| Example 4 | 0.55 |
| Example 5 | 0.60 |
| Example 6 | 0.64 |
| Example 7 | 0.72 |
| Example 8 | 1.02 |

From the foregoing, it will be appreciated that, although specific embodiments of the present disclosure have been described herein for purposes of illustration, various modifications may be made without deviating from the spirit and scope of the present disclosure. Accordingly, the present disclosure is not limited except as by the appended claims.

What is claimed is:

1. A method for manufacturing lutetium oxide doped Mo cathode block, comprising:

preparing lutetium oxide doped Mo powders;

die-pressing the lutetium oxide doped Mo powders into pellets; and sintering the pellets to obtain the lutetium oxide doped Mo cathode block.

2. The method of claim 1, wherein the concentration of lutetium oxide in the lutetium oxide doped Mo cathode block ranges from 1 to 4% by weight.

3. The method of claim 1, wherein the lutetium oxide doped Mo powders are prepared by sol-gel method.

4. The method of claim 1, wherein the pellets are sintered in hydrogen at a temperature between 1800° C. and 2000° C.

5. The method of claim 3, wherein the sol-gel method comprises:

dissolving $Lu(NO_3)_3.H_2O$, $(NH_4)_6Mo_7O_{24}.4H_2O$ and $C_6H_8O_7.H_2O$ in de-ionized water to prepare aqueous solutions of $Lu(NO_3)_3$, $(NH_4)_6Mo_7O_{24}$ and citric acid, respectively, adding the $Lu(NO_3)_3$ solution and citric acid into the $(NH_4)_6Mo_7O_{24}$ solution simultaneously and slowly with persistently agitation to obtain a wet gel;

drying the wet gel to obtain dried xerogel;

calcining the dried xerogel to obtain calcined powders; and reacting the calcined powders in hydrogen.

6. The method of claim 5, wherein the mass of citric acid is 1 to 1.3 times of the mass of $(NH_4)_6Mo_7O_{24}.4H_2O$.

7. The method of claim 5, wherein the dried xerogel is thoroughly calcined in air at a temperature between 500° C. and 600° C.

8. The method of claim 5, wherein the lutetium oxide doped Mo powders are prepared by two steps: calcining the calcined powders in hydrogen at 500-550° C. for 2 h to obtain lutetium oxide doped $MoO_2$ powders; calcining the lutetium oxide doped $MoO_2$ powders further in hydrogen at 850-950° C. for 2 h to obtain the lutetium oxide doped Mo powders.

9. A method of making carburized lutetium oxide doped molybdenum cathode comprising reacting a lutetium oxide doped molybdenum cathode with activated carbon powders.

10. The method of claim 9, wherein the reacting a lutetium oxide doped molybdenum cathode with activated carbon powders is conducted at 1400-1500° C. for 5-20 min in hydrogen.

11. A lutetium oxide doped molybdenum cathode material, comprising molybdenum substrate made of molybdenum and doped with lutetium oxide, wherein the lutetium oxide doped molybdenum cathode material contains 1 to 4% by weight of lutetium oxide and 99 to 96% by weight of the molybdenum substrate.

12. The lutetium oxide doped molybdenum cathode material of claim 11, wherein the lutetium oxide doped molybdenum cathode material contains 3 to 4% by weight of lutetium oxide and 97 to 96% by weight of the molybdenum substrate.

13. The lutetium oxide doped molybdenum cathode material of claim 11 manufactured according to the method of claim 1.

* * * * *